US008378904B1

(12) United States Patent
Colich et al.

(10) Patent No.: US 8,378,904 B1
(45) Date of Patent: Feb. 19, 2013

(54) ANTENNA FOR HIGH TEMPERATURE THERMAL PROTECTION SYSTEM

(75) Inventors: Joseph M. Colich, St. Louis, MO (US); Lee F. Scuderi, St. Peters, MO (US); Edward A. Eiswirth, Chesterfield, MO (US)

(73) Assignee: The Boeing Company, Chicago, IL (US)

( * ) Notice: Subject to any disclaimer, the term of this patent is extended or adjusted under 35 U.S.C. 154(b) by 314 days.

(21) Appl. No.: 12/794,166

(22) Filed: Jun. 4, 2010

(51) Int. Cl.
*H01Q 1/28* (2006.01)
*H01Q 13/00* (2006.01)

(52) U.S. Cl. ..... 343/705; 343/708; 343/784

(58) Field of Classification Search ..... 343/705, 343/708, 784
See application file for complete search history.

(56) References Cited

U.S. PATENT DOCUMENTS 2,560,265 A * 7/1951 Adler, Jr. ..... 342/455
2,689,302 A * 9/1954 Albano ..... 343/789
3,579,242 A * 5/1971 Grantham ..... 343/708
4,006,480 A 2/1977 Charette et al.
4,748,449 A * 5/1988 Landers et al. ..... 343/705
5,356,608 A 10/1994 Gebhardt
5,517,203 A * 5/1996 Fiedziuszko ..... 343/756
7,075,480 B2 * 7/2006 Fehrenbach et al. ..... 342/124
2007/0024505 A1 2/2007 Geisheimer et al.

OTHER PUBLICATIONS

Kuhlman, E.A.; Investigation of High Temperature Antennas for Space Shuttle; prepared by McDonnel Douglas Astronautics Company-East, St. Louis, MO for Langley Research Center; NASA CR-2294; Nov. 1973; 152 pages.

* cited by examiner

*Primary Examiner* — Hoang V Nguyen
(74) *Attorney, Agent, or Firm* — Armstrong Teasdale LLP

(57) ABSTRACT

An antenna is provided for use with a vehicle that includes a body that is encased by a thermal protection system (TPS). An opening extends through the TPS and the vehicle body, and an antenna assembly and a seal member are positioned within the opening. The seal member extends about the antenna assembly and is radio frequency (RF) opaque. A window extends across the opening to retain the antenna assembly and seal member within the opening. The window is RF transparent.

21 Claims, 3 Drawing Sheets

300

ANTENNA FOR HIGH TEMPERATURE THERMAL PROTECTION SYSTEM

BACKGROUND

The subject matter described herein relates generally to antenna systems and more particularly to antenna systems for use with a high speed vehicle.

Vehicles generate air friction when travelling at high speeds. High temperatures may be created as a result of such air friction, depending on an amount and/or duration of such air friction. For example, vehicles travelling at hypersonic speeds may generate outer aeroshell temperatures in excess of 3000° F. Moreover, such conditions may cause the vehicle to at least partially distort during high speed travel, including a thermal expansion and/or a physical shifting of individual parts and/or components due to forces and/or moments. Moreover, because of differences in exposure and/or materials used to fabricate the components, different components may distort at different rates.

Some known vehicles include an antenna system such as, but not limited to, a global positioning system, a telemetry/telecommand system, and/or range safety communication that obtain position data and/or that monitor the vehicle during operation. Although some known antenna systems are installed from the interior of the vehicle, at least some known antenna systems require complex assembly methods and include helical or cantilever springs. Such springs enable the antenna system to move relative to the vehicle, but are limited to predetermined preload designs and may be subject to certain assembly tolerances, creep, and/or high temperature distortion.

BRIEF DESCRIPTION

In one aspect, a method is provided for installing an antenna system. The method includes substantially encasing a vehicle body with a thermal protection system (TPS). An opening that extends through the TPS and through the vehicle body is formed, and an antenna assembly and a seal member are positioned within the opening such that the seal member extends about the antenna assembly. The seal member is fabricated at least partially from a radio frequency (RF) opaque material. A window is positioned across the opening to retain the antenna assembly and seal member within the opening. The window is fabricated at least partially from an RF transparent material.

In another aspect, an antenna system is provided for use with a vehicle including a body and a thermal protection system (TPS) that substantially encases the body. The antenna system includes a window sized to extend across an opening extending through the TPS and the body, an antenna assembly sized to fit within the opening, and a seal member sized to fit within the opening and extend about the antenna assembly. The window is fabricated at least partially from a radio frequency (RF) transparent material, and the seal member is fabricated at least partially from an RF opaque material.

In yet another aspect, a vehicle is provided. The vehicle includes a body, a thermal protection system (TPS) that substantially encases the body, and an antenna system. An opening extends through the TPS and the body. The antenna system includes a window sized to extend across the opening, an antenna assembly sized to fit within the opening, and a seal member sized to fit within the opening and extend about the antenna assembly. The window is fabricated at least partially from a radio frequency (RF) transparent material, and the seal member is fabricated at least partially from an RF opaque material.

The features, functions, and advantages that have been discussed can be achieved independently in various embodiments of the present invention or may be combined in yet other embodiments further details of which can be seen with reference to the following description and drawings.

DETAILED DESCRIPTION

The subject matter described herein relates generally to antenna systems. More particularly, the subject matter described herein relates to methods and systems for installing an antenna system for use with a high speed vehicle. In one embodiment, a high speed vehicle includes a body that is encased by a radio frequency (RF) opaque thermal protection system (TPS). An opening extends through the TPS and through the vehicle body, and an antenna assembly and a RF opaque seal member are positioned within the opening. The seal member, which is compliant and high-temperature resistant, extends about the antenna assembly. An RF transparent window extending across the opening is oriented such that the antenna assembly compresses the seal member against the wall of the opening.

As used herein, an element or step recited in the singular and proceeded with the word "a" or "an" should be understood as not excluding plural elements or steps unless such exclusion is explicitly recited. Furthermore, references to "one embodiment" of the present invention are not intended to be interpreted as excluding the existence of additional embodiments that also incorporate the recited features.

Figure 1:
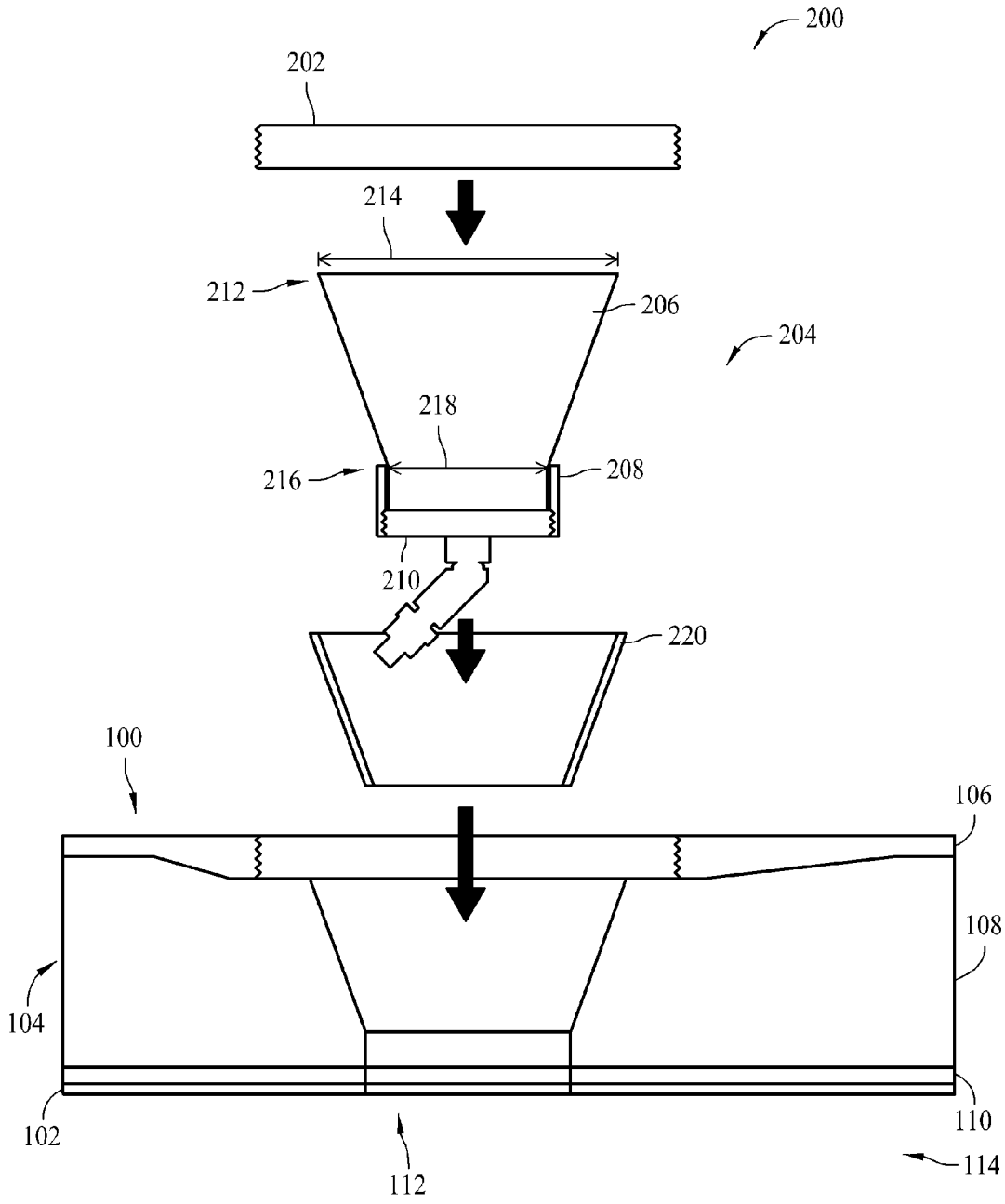
FIG. 1 is an illustration of an exemplary antenna system that may be used with a high speed vehicle.

FIG. 1 illustrates an exemplary vehicle 100. In the exemplary embodiment, vehicle 100 is a high speed vehicle such as, but not limited to, a hypersonic missile and/or an aircraft. Vehicle 100, in the exemplary embodiment, includes an airframe structure or body 102 and a thermal protection system (TPS) 104 that substantially encases and/or surrounds body 102.

In the exemplary embodiment, TPS 104 is a dual layer TPS that facilitates protecting vehicle 100 from extreme environments. More specifically, in the exemplary embodiment, TPS 104 includes a carbon/carbon-silicone carbide (C/C—SiC) outer aeroshell 106 that is bonded to a substantially rigid carbon bonded-carbon fiber (CBCF) insulation 108. Alternatively, TPS 104 may have any suitable number of layers that are each fabricated from any suitable material that enables vehicle 100 to function as described herein.

In the exemplary embodiment, TPS 104 is bonded to a compliant carbon felt strain isolation layer 110 that is bonded to the rigid structure 102. Strain isolation layer 110 enables TPS 104 to thermally expand independently of any thermal expansion of structure 102. More specifically, in the exemplary embodiment, strain isolation layer 110 is selected to have a low stiffness that provides a relative movement between TPS 104 and structure 102 of approximately 0.02-0.10 inches (in.) radially and of approximately 0.04-0.12 in. axially. More particularly, in the exemplary embodiment, the low stiffness of strain isolation layer 110 enables a typical shear and/or a compressive strain of approximately 50 percent. Alternatively, strain isolation layer 110 may be selected to enable a relative movement between TPS 104 and structure 102 of greater than approximately 0.06 in. radially and of greater than approximately 0.09 in. axially.

In the exemplary embodiment, structure 102, outer aeroshell 106, and/or insulation 108 are substantially opaque to radio frequencies (RF) such that RF generally are not transmittable through outer aeroshell 106 and/or insulation 108. As such, an opening 112 is formed to enable RF signals to be transmitted to an interior 114 of structure 102. In the exemplary embodiment, opening 112 extends through TPS 104 and structure 102 and is sized and/or oriented to accommodate an antenna system 200 that may be used with vehicle 100. More specifically, in the exemplary embodiment, opening 112 is substantially conical in shape.

Figure 2:
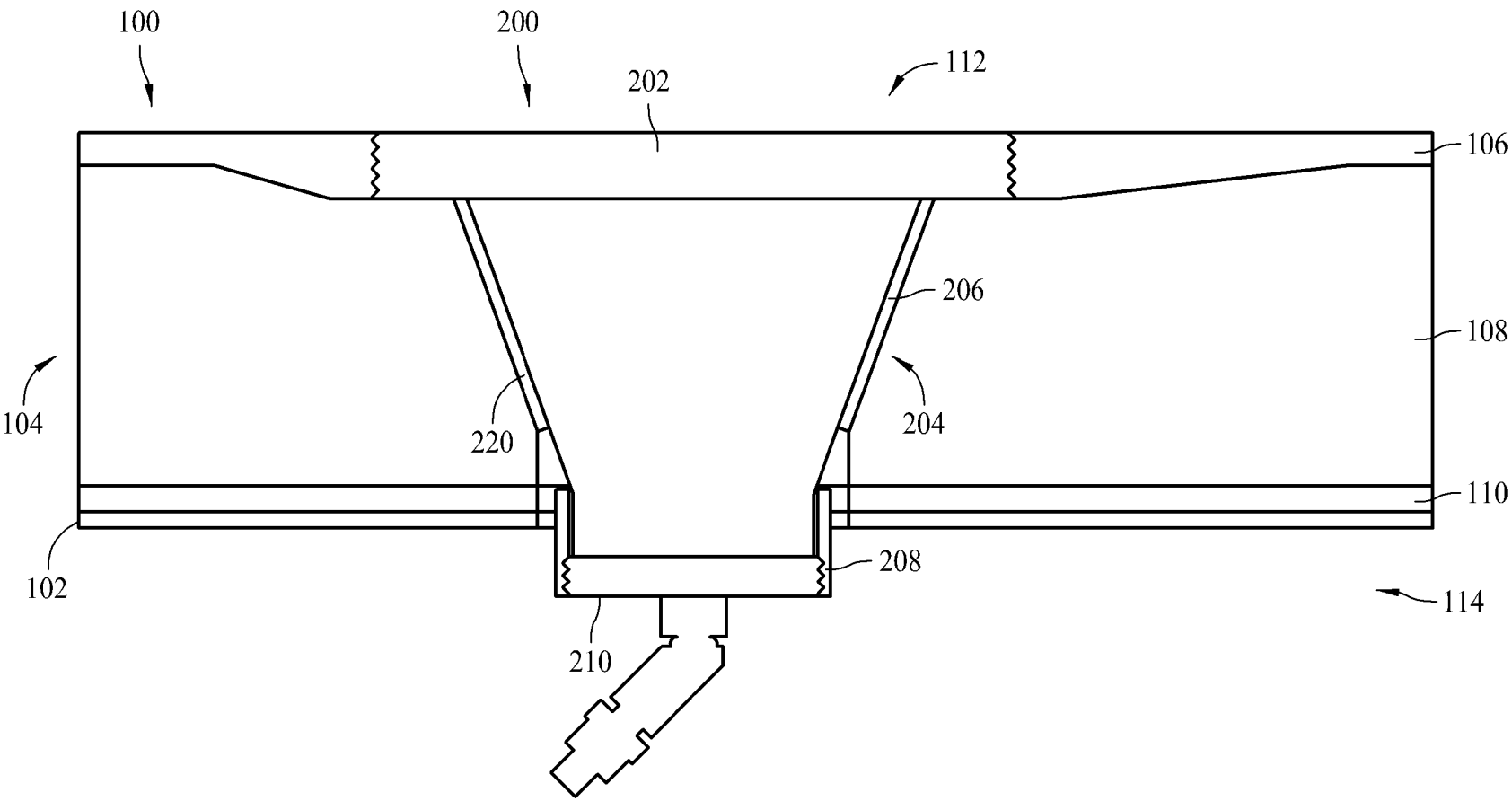
FIG. 2 is a cross-sectional illustration of the antenna system illustrated in FIG. 1 in an assembled configuration.

In FIG. 1, antenna system 200 is illustrated in an expanded or disassembled configuration, and, in FIG. 2, antenna system 200 is illustrated in an assembled configuration. In the exemplary embodiment, system 200 includes a high-temperature resistant, RF transparent window 202 that enables RF signals to be transmitted therethrough. For example, in the exemplary embodiment, window 202 is fabricated from quartz-polysiloxane. Alternatively, window 202 may be fabricated from any suitable material that enables system 200 to function as described herein.

Window 202 is sized and/or oriented to extend across opening 112 such that an outer surface (not numbered) of window 202 is substantially flush with an outer surface (not numbered) of TPS 104 and, more specifically, an outer surface (not numbered) of outer aeroshell 106. In the exemplary embodiment, outer aeroshell 106 and window 202 are each threaded to enable window 202 to threadably couple to outer aeroshell 106. More specifically, in the exemplary embodiment, outer aeroshell 106 and window 202 are each threaded with a unified national fine thread. As such, window 202 is generally coupled to outer aeroshell 106 from an exterior of vehicle 100 and does not require bonding to secure window 202 in position relative to vehicle 100. Alternatively, window 202 may be coupled to outer aeroshell 106 using any suitable method and/or mechanism that enables system 200 to function as described herein.

In the exemplary embodiment, antenna system 200 includes an antenna assembly 204 that is sized and/or shaped to fit within opening 112. More specifically, in the exemplary embodiment, antenna assembly 204 includes a thermally-insulating, RF conductive waveguide 206, an antenna retainer 208, and a metallic disk-shaped microstrip antenna element 210. In the exemplary embodiment, waveguide 206 is fabricated from alumina-silica fibrous ceramic foam that is thermally-insulating, and antenna retainer 208 is fabricated from a metallic material. Alternatively, waveguide 206 and/or antenna retainer 208 may be fabricated from any suitable material that enables system 200 to function as described herein.

Waveguide 206 includes an upper portion 212 that has a first diameter 214 and a lower portion 216 that has a second diameter 218. In the exemplary embodiment, first diameter 214 is wider than second diameter 218 such that antenna assembly 204 and, more specifically, waveguide 206 is substantially conical in shape. In the exemplary embodiment, a vulcanizing silicone adhesive is used to bond antenna retainer 208 to waveguide lower portion 216. Alternatively, antenna retainer 208 may be coupled to outer waveguide 206 using any suitable method and/or mechanism that enables system 200 to function as described herein.

In the exemplary embodiment, antenna retainer 208 and antenna element 210 are each threaded to enable antenna element 210 to threadably couple to antenna retainer 208. Alternatively, antenna element 210 may be coupled to outer antenna retainer 208 using any suitable method and/or mechanism that enables system 200 to function as described herein.

A seal member 220 is sized and/or shaped for insertion within opening 112 such that seal member 220 circumscribes a portion of antenna assembly 204. In the exemplary embodiment, seal member 220 is fabricated from an RF opaque material, such as, but not limited to, a high-temperature resistant felt material. In the exemplary embodiment, at least a portion of seal member 220 includes carbon. Alternatively, seal member 220 may be fabricated from any suitable material that enables system 200 to function as described herein.

Figure 3:
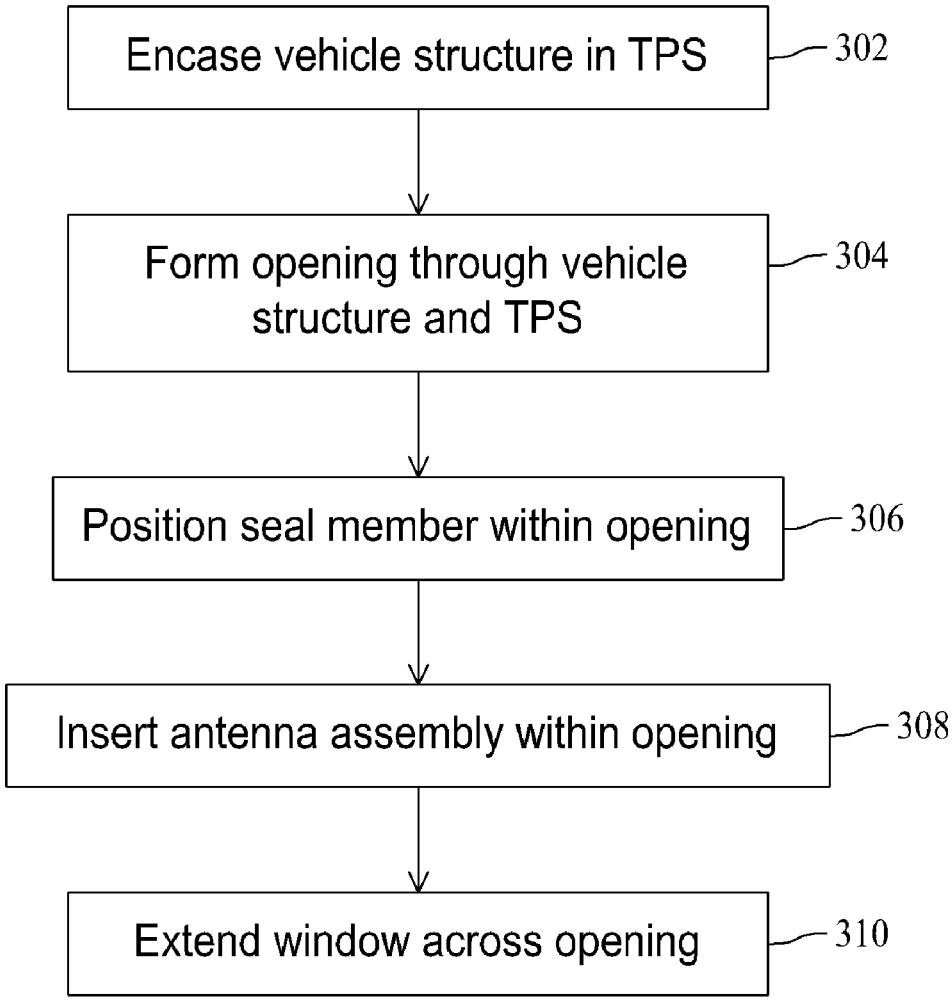
FIG. 3 is a flow chart illustrating an exemplary method for installing the system shown in FIG. 1.

FIG. 3 is a flow chart illustrating an exemplary method 300 for installing antenna system 200. In the exemplary embodiment, vehicle structure 102 is substantially encased 302 by TPS 104 such that structure 102 is substantially protected from extreme environments. Opening 112 is formed 304 to extend through TPS 104 and through structure 102 and is suitably sized and/or shaped to receive system 200 therein.

Seal member 220 is positioned 306 within opening 112 such that seal member 220 is positioned substantially against CBCF insulation 108. Waveguide lower portion 216 is bonded to antenna retainer 208, and antenna element 210 is threadably coupled to antenna retainer 208 to form antenna assembly 204. Antenna assembly 204 is then inserted 308 at least partially within opening 112 such that seal member 220 circumscribes antenna assembly 204. Accordingly, when fully inserted in position, seal member 220 extends between antenna assembly 204 and the encasing CBCF insulation 108 such that system 200 and, more specifically, antenna assembly 204 is allowed to "float" within opening 112. In other words, structure 102 is not directly coupled to antenna assembly 204, but rather is separated by seal member 220 and has substantially no contact and, therefore, substantially no effect on antenna assembly 204. Seal member 220 substantially seals opening 112 to prevent high temperature gas from entering vehicle 100.

Window 202 extends 310 across opening 112 to retain antenna assembly 204 and seal member 220 within opening 112 and below window 202. As such, window 202 biases antenna assembly 204 and/or seal member 220 against the encasing CBCF insulation 108. When assembled, waveguide 206 is positively pressed against window 202 by a preload imposed by the compressed seal member 220. In the exemplary embodiment, window 202 is threadably coupled to outer aeroshell 106 such that the outer surface of window 202 is substantially flush with the outer surface of outer aeroshell 106. During operation of vehicle 100, window 202 and waveguide 206 transmit a compression load from an external airflow pressure to the encasing TPS 104.

The exemplary methods and systems described herein facilitate installing an antenna system that accommodates for relative movement between the TPS and the vehicle structure described above. As such, no load due to relative motion between the TPS and the vehicle structure is imposed onto the antenna system as a whole and/or its components. The antenna system is installable from an exterior of the TPS and does not require bonding to secure the window to the vehicle, thereby making it easier to install. More specifically, the antenna system includes a window that enables RF signals to be transmitted to an antenna element positioned within the vehicle with little distortion or attenuation and thermal protection suitable to maintain the internal antenna element at relatively low temperatures. An RF waveguide is provided to further facilitate thermally protecting the antenna element from extreme conditions.

The embodiments described herein provide for installing an antenna system for a high speed vehicle. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the present invention, including the best mode, and also to enable any person skilled in the art to practice those certain embodiments, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for installing an antenna system on a vehicle body that is substantially encased with a thermal protection system (TPS), said method comprising:

forming an opening that extends through the TPS and through the vehicle body;

positioning an antenna assembly and a seal member within the opening such that the seal member extends about the antenna assembly and is fabricated at least partially from a radio frequency (RF) opaque material;

positioning a window across the opening to retain the antenna assembly and seal member within the opening, wherein the window is fabricated at least partially from an RF transparent material; and threadably coupling the window to an outer aeroshell of the TPS such that an outer surface of the window is substantially flush with an outer surface of the outer aeroshell.

2. A method in accordance with claim 1, wherein positioning an antenna assembly further comprises bonding an insulating waveguide to an antenna retainer.

3. A method in accordance with claim 1, wherein positioning an antenna assembly further comprises threadably coupling an antenna element to an antenna retainer.

4. An antenna system for use with a vehicle including a body and a thermal protection system (TPS) that substantially encases the body, said antenna system comprising:

a window sized to extend across an opening extending through the TPS and the body, wherein said window is fabricated at least partially from a radio frequency (RF) transparent material;

an outer aeroshell threadably coupled to said window such that an outer surface of said window is substantially flush with an outer surface of said outer aeroshell;

an antenna assembly sized to fit within the opening; and a seal member sized to fit within the opening and extend about said antenna assembly, wherein said seal member is fabricated at least partially from an RF opaque material.

5. An antenna system in accordance with claim 4, wherein said window is fabricated at least partially from a quartz material.

6. An antenna system in accordance with claim 4, wherein the TPS includes an outer aeroshell, said antenna assembly having a first diameter proximate to the outer aeroshell and a second diameter proximate to the body, the first diameter is greater than the second diameter such that said antenna assembly has a substantially conical shape.

7. An antenna system in accordance with claim 4, wherein said antenna assembly comprises an insulating waveguide, an antenna retainer, and an antenna element.

8. An antenna system in accordance with claim 7, wherein said insulating waveguide is bonded to said antenna retainer.

9. An antenna system in accordance with claim 7, wherein said antenna element is threadably coupled to said antenna retainer.

10. An antenna system in accordance with claim 7, wherein said insulating waveguide is fabricated at least partially from a ceramic foam material.

11. An antenna system in accordance with claim 4, wherein said seal member is fabricated at least partially from a carbon material.

12. A vehicle comprising:

a body;

a thermal protection system (TPS) that substantially encases said body, wherein an opening extends through said TPS and said body, said TPS comprising an outer aeroshell; and an antenna system comprising a window sized to extend across the opening, an antenna assembly sized to fit within the opening, and a seal member sized to fit within the opening and extend about said antenna assembly, wherein said window is fabricated at least partially from a radio frequency (RF) transparent material and said seal member is fabricated at least partially from an RF opaque material, said outer aeroshell threadably coupled to said window such that an outer surface of said window is substantially flush with an outer surface of said outer aeroshell.

13. A vehicle in accordance with claim 12, wherein said window is fabricated at least partially from a quartz material.

14. A vehicle in accordance with claim 12, wherein said antenna assembly has a first diameter proximate to said outer aeroshell and a second diameter proximate to said body, the first diameter is greater than the second diameter such that said antenna assembly has a substantially conical shape.

15. A vehicle in accordance with claim 12, wherein said antenna assembly comprises an insulating waveguide, an antenna retainer, and an antenna element.

16. A vehicle in accordance with claim 15, wherein said insulating waveguide is bonded to said antenna retainer, wherein said insulating waveguide is fabricated at least partially from a ceramic foam material.

17. A vehicle in accordance with claim 15, wherein said antenna element is threadably coupled to said antenna retainer.

18. A vehicle in accordance with claim 12, wherein said seal member is fabricated at least partially from a carbon material.

19. A method for installing an antenna system on a vehicle body that is substantially encased with a thermal protection system (TPS), said method comprising:

forming an opening that extends through the TPS and through the vehicle body;

threadably coupling an antenna element to an antenna retainer to form an antenna assembly; and positioning the antenna assembly and a seal member within the opening such that the seal member extends about the antenna assembly and is fabricated at least partially from a radio frequency (RF) opaque material; and positioning a window across the opening to retain the antenna assembly and seal member within the opening, wherein the window is fabricated at least partially from an RF transparent material.

20. An antenna system for use with a vehicle including a body and a thermal protection system (TPS) that substantially encases the body, said antenna system comprising:

a window sized to extend across an opening extending through the TPS and the body, wherein said window is fabricated at least partially from a radio frequency (RF) transparent material;

an antenna assembly sized to fit within the opening, wherein the antenna assembly comprises an antenna retainer and an antenna element threadably coupled to the antenna retainer; and a seal member sized to fit within the opening and extend about said antenna assembly, wherein said seal member is fabricated at least partially from an RF opaque material.

21. A vehicle comprising:

a body;

a thermal protection system (TPS) that substantially encases said body, wherein an opening extends through said TPS and said body; and an antenna system comprising a window sized to extend across the opening, an antenna assembly sized to fit within the opening, and a seal member sized to fit within the opening and extend about said antenna assembly, wherein said window is fabricated at least partially from a radio frequency (RF) transparent material and said seal member is fabricated at least partially from an RF opaque material, said antenna assembly comprising an antenna retainer and an antenna element threadably coupled to the antenna retainer.

* * * * *